US006089112A

United States Patent [19]

Kelly et al.

[11] Patent Number: 6,089,112

[45] Date of Patent: Jul. 18, 2000

[54] METHOD AND APPARATUS FOR STARTING AN ENGINE

[75] Inventors: Christopher J. Kelly, Racine, Wis.; Robert J. Oliver, Westmont, Ill.; Donald A. Cech, Orland Park, Ill.; Allan D. Hillyer, North Aurora, Ill.

[73] Assignee: Case Corporation, Racine, Wis.

[21] Appl. No.: 09/019,568

[22] Filed: Feb. 6, 1998

[51] Int. Cl.[7] ..... F02N 15/02

[52] U.S. Cl. ..... 74/7 C; 74/7 E; 192/45.1; 192/46; 192/113.32; 290/36 R; 290/37 R; 290/38 A; 290/38 R; 123/179.25

[58] Field of Search ..... 74/7 C, 7 E; 192/45.1, 192/46, 113.32; 290/38 R, 38 A, 36 R, 37 R; 123/179.25

[56] References Cited

U.S. PATENT DOCUMENTS

| | | | |
|---|---|---|---|
| 1,253,871 | 1/1918 | O'Neill | 123/179.25 |
| 1,472,872 | 11/1923 | Kindl | 123/179.25 |
| 1,883,432 | 10/1932 | Whitney | 123/179.25 |
| 3,198,305 | 8/1965 | Marland et al. | 192/113.32 |
| 4,494,414 | 1/1985 | Hamano | 74/7 E |
| 4,543,923 | 10/1985 | Hamano et al. | 123/179.25 |
| 4,931,680 | 6/1990 | Sugiyama | 123/179.25 |
| 4,983,151 | 1/1991 | Pires . | |
| 5,054,594 | 10/1991 | Kämpf et al. . | |
| 5,070,978 | 12/1991 | Pires | 192/45.1 |
| 5,095,865 | 3/1992 | Keister | 123/179.25 |
| 5,108,352 | 4/1992 | Pires . | |
| 5,127,279 | 7/1992 | Barthruff | 74/6 |
| 5,143,189 | 9/1992 | Meier-Burkamp . | |
| 5,226,859 | 7/1993 | Pires . | |
| 5,257,685 | 11/1993 | Tichiaz et al. . | |
| 5,334,115 | 8/1994 | Pires . | |
| 5,370,008 | 12/1994 | Landolt . | |
| 5,474,152 | 12/1995 | Wilkinson et al. | 192/113.32 |
| 5,505,169 | 4/1996 | Mummert et al. | 290/38 R |
| 5,549,011 | 8/1996 | Shiga et al. . | |
| 5,596,902 | 1/1997 | McMillen | 74/7 C |
| 5,597,057 | 1/1997 | Ruth et al. | 192/45.1 |
| 5,806,643 | 9/1998 | Fitz | 192/45.1 |

*Primary Examiner*—David A. Bucci
*Assistant Examiner*—Chong H. Kim
*Attorney, Agent, or Firm*—Foley & Lardner

[57] ABSTRACT

A starter assembly for starting an engine is provided incorporating a mechanical diode in the drive train between the starter motor and the engine, including two coaxial plates with facing surfaces that are linked by pivoting members. The pivoting members are recessed into a facing surface of the first plate. They pivot outward under spring force from the facing surface of the first plate to engage slots in the facing surface of the second plate. This allows the first plate to drive the second plate, but also allows the second plate to overrun the first plate.

11 Claims, 6 Drawing Sheets

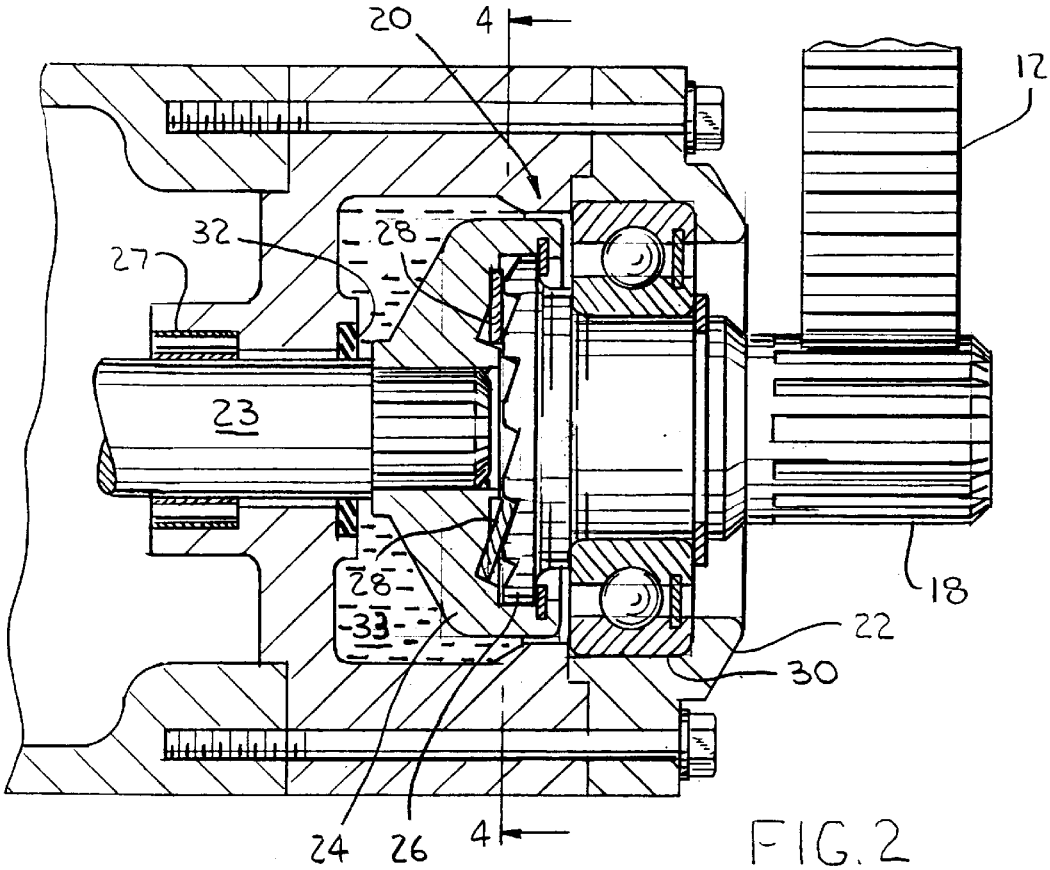
FIG. 2
FIG. 3
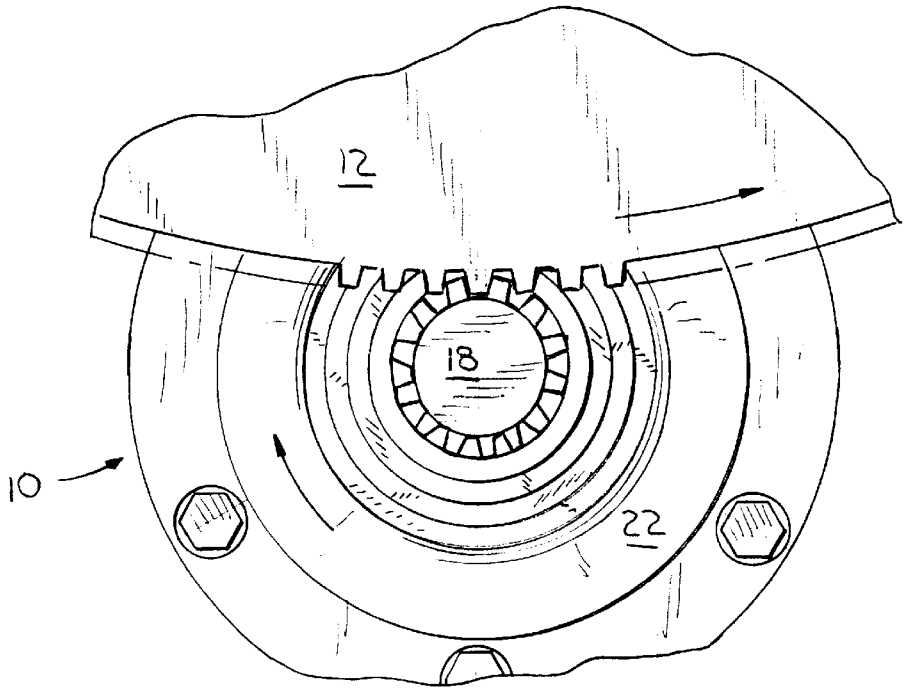

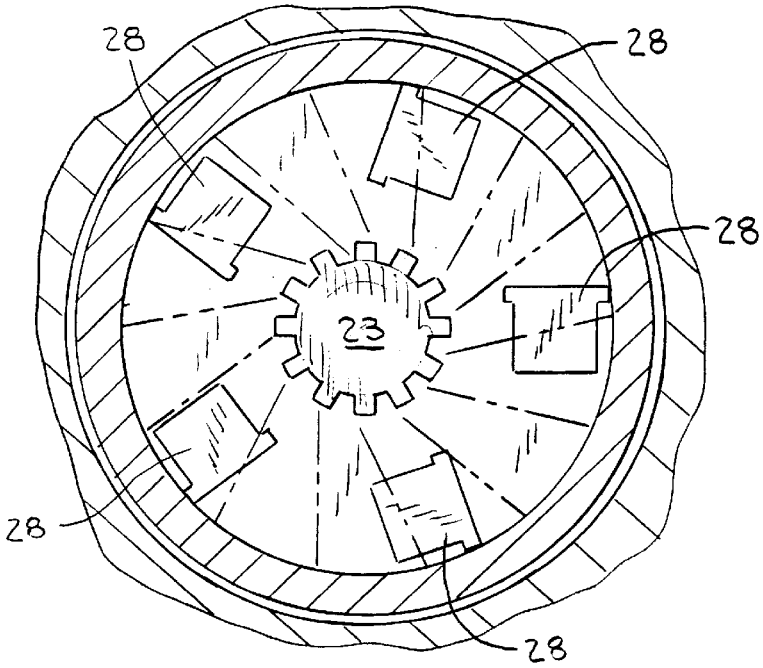
FIG. 4
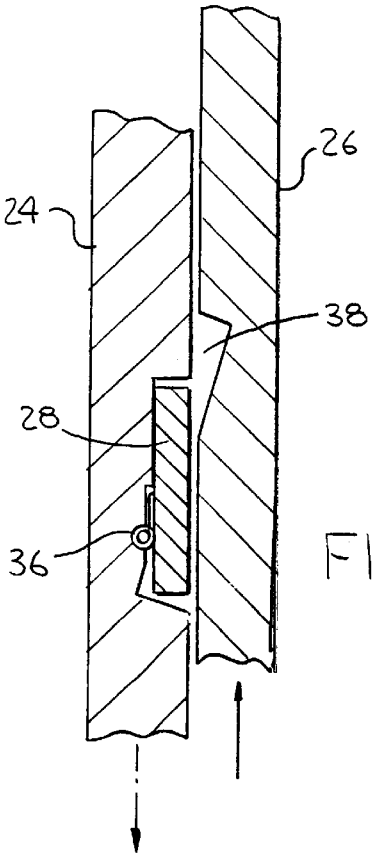
FIG. 6
FIG. 5
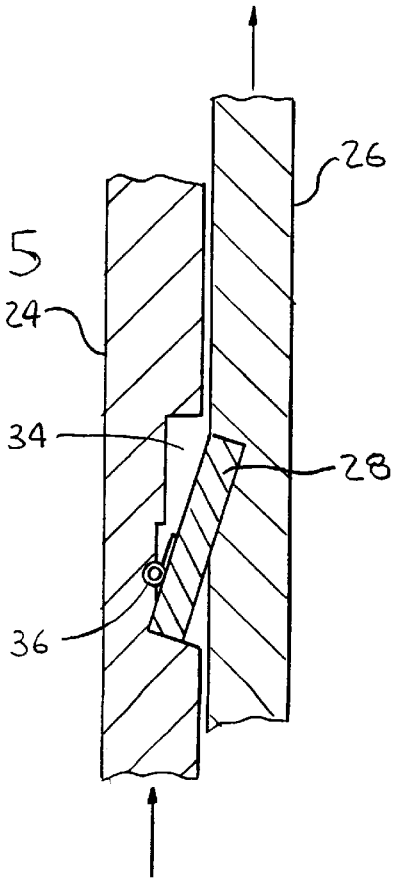

METHOD AND APPARATUS FOR STARTING AN ENGINE

FIELD OF THE INVENTION

This invention relates to couplings between engines and starter motors. More particularly, it relates to the disposition of mechanical diodes in a starter gear train between an engine and a starter motor.

BACKGROUND OF THE INVENTION

Engine starters often include mating elements that allow the transmission or torque from the starter motor to the starter pinion to transmit a torque generated from the starter motor to the rotating engine component that is engaged to the starter pinion. These elements typically provide an overrunning capability that allows torque to be transmitted from the starter motor to the starter pinion, but not from the starter pinion to the starter motor. In this manner, the starter motor can rotate the starter pinion, typically engaged to a flywheel or other rotating gear coupled to a crankshaft or turbine shaft. When the engine starts, the velocity of the rotating gear on the engine increases radically, to a speed much faster than the rotating starter can withstand. To prevent the starter from self-destructing due to this high velocity, these torque transmitting elements prevent the engine from applying a torque to the starter motor. A sprag clutch is one element commonly used as the torque transmitting elements in such applications as reciprocating internal combustion engines or the like.

Sprag clutches are usually in the form of a first shaft member coupled to the starter motor, and a second hollow cylindrical member attached to the starter pinion. Sprags, or oblong elements, are disposed circumferentially around the gap between the shaft member and the inside of the hollow cylindrical member such that they wedge between the inside of the hollow cylindrical member and the pinion when the pinion is rotated in a first direction with respect to the hollow cylindrical member, and are released when the shaft member is rotated in the opposite direction with respect to the hollow cylindrical member. Thus, the motor will wedge the sprags between the shaft member and the hollow member until the engine starts, at which time the hollow member, driven by the now-started engine, will increase in speed until it rotates faster than the shaft member, and the sprags will be released.

A drawback of this design is the need for a thick, and hence relatively massive hollow cylindrical member. This member must be thick to withstand the forces acting outwardly against the hollow member by the sprags during starting, and to withstand the centrifugal forces generated when the engine rotates the starter pinion after starting.

One method of improving upon this design is to insert a bendix in the mechanical train between the sprag clutch to cause the starter pinion to be moved back and away from the rotating gear on the engine when the engine starts. This design requires an additional element to the arrangement, however, the bendix.

What is needed is a simple apparatus for preventing torque transmittal from the gear on the engine to the starter motor that eliminates the need for a sprag and bendix. It is an object of this invention to provide such an apparatus.

SUMMARY OF THE PRESENT INVENTION

In accordance with a first embodiment of the invention, a starter assembly is disclosed, having a starter motor, a first rotating disk with a surface perpendicular to its axis of rotation coupled to the starter, a second disk that rotates about the same axis having a surface perpendicular to the axis of rotation and facing the first disk, several coupling plates disposed between the two surfaces to couple them together, each plate having a spring located between it and the first disk's surface to pivot it outward toward the second disk's surface. The second disk may be connected to and coaxial with a gear having teeth configured to engage a flywheel. The starter motor may have the same axis of rotation as the first disk. A spur gear train may be disposed between the starter motor and the first disk. The gear train may include a second gear coupled to the starter motor and a third gear coupled to the first disk. A fourth gear may be disposed between the second and third gear. A right angle gear train may be disposed between the starter motor and the first disk. The right angle gear train may include a first bevel gear fixed to the starter motor shaft and a second bevel gear rotationally coupled to the first bevel gear and fixed to the first disk. A first spur gear may be coupled to the second bevel gear and an internal spur gear may be fixed to the first disk and rotationally coupled to the first spur gear, whereby the second bevel gear is rotationally coupled to the first disk. The second disk may be a flywheel.

In accordance with a second embodiment of the invention, a method of starting an engine is disclosed, including the steps of energizing a starter motor having an output shaft for the transmission of torque generated by the starter motor, applying the torque to a first disk having a plurality of recesses on a first surface, rotating the disk in a first rotational direction that defines an axis of rotation substantially perpendicular to the first surface, outwardly pivoting a first end of a coupling plate disposed in a recess in a direction substantially parallel to the axis of rotation or about a pivot axis substantially perpendicular to the axis of rotation or about a pivot axis substantially parallel to the plane of the first surface, engaging a slot in a second disk tht is also disposed to rotate about the axis of rotation and is rotationally coupled to an engine crankshaft or flywheel, transmitting torque from the first disk to the second disk through the coupling plate, rotating the second disk in the first rotational direction, and turning the crankshaft or flywheel.

Other principal features and advantages of the invention will become apparent to those skilled in the art upon review of the following drawings, the detailed description and the appended claims.

BRIEF DESCRIPTION OF THE DRAWINGS

FIG. 2 is a detailed sectional view of the starter and flywheel of FIG. 1;

FIG. 3 is an end view of the starter and flywheel of FIG. 2;

FIG. 4 is a sectional view of the mechanical diode of FIG. 2 taken at section 4—4 of FIG. 2;

FIGS. 5 and 6 are detailed partial cross-sectional views of the mechanical diode of FIGS. 2 and 4, respectively, showing one of the coupling plates in an engaged (FIG. 5) and a disengaged (FIG. 6) position;

Figure 1:
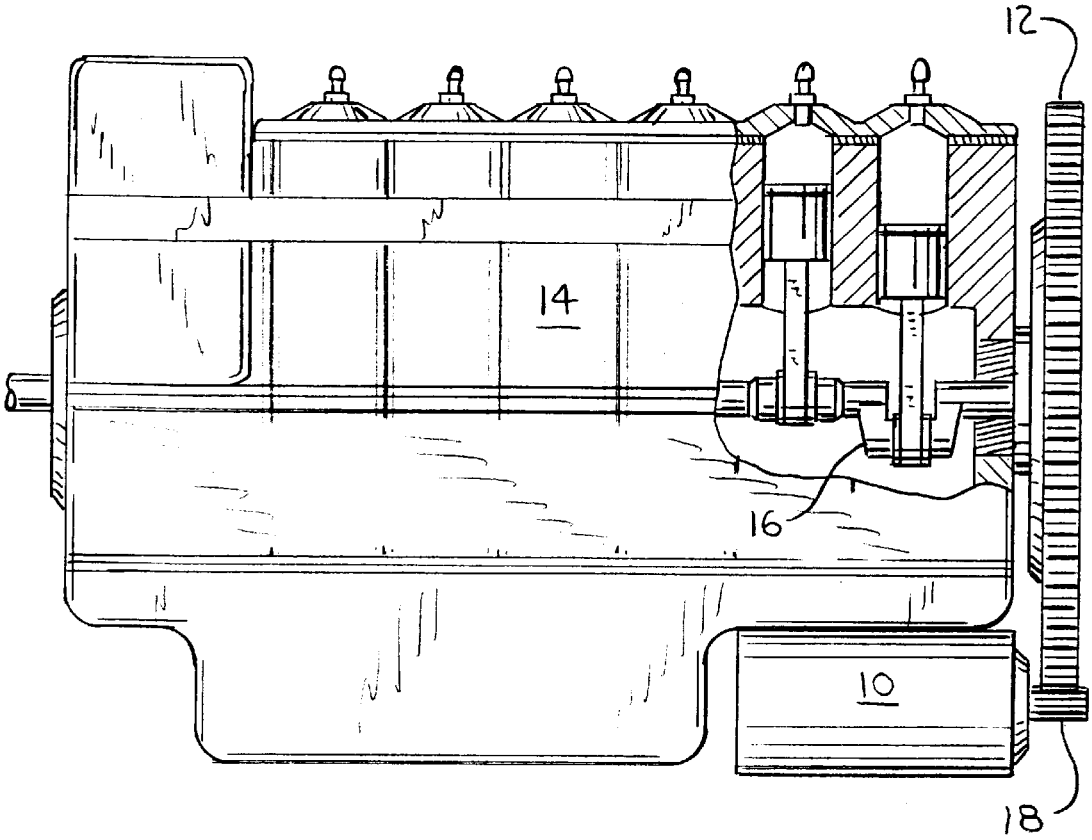
FIG. 1 illustrates an internal combustion engine having a crankshaft and a starter to which it is rotationally engaged.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIG. 1, a starter assembly 10 is shown coupled to a flywheel 12 for starting engine 14. Starter assembly 10 has a pinion 18 extending from one end that is engaged to teeth on flywheel 12 which, in turn, is coupled to crankshaft 16. When starter assembly 10 rotates, therefore, it rotates flywheel 12 and starts engine 14.

Referring to FIGS. 2 and 3, starter assembly 10 includes a mechanical diode 20 disposed within starter housing 22 between the starter motor (not shown) that is coupled to the leftmost end of shaft 23 and to starter pinion 18. Mechanical diode 20 couples torque generated by the starter motor to starter pinion 18. Mechanical diode 20 is configured as two substantially coaxial disks 24, 26 having facing surfaces and a plurality of coupling plates 28 disposed therebetween. The coupling plates 28 transmit torque from disk 24 to disk 26, and thence through starter pinion 18 to flywheel 12 to start engine 14. Disk 24 is fixed to the right end of shaft 23 and disk 26 is fixed to the left end of starter pinion 18. Needle bearings 27 support shaft 23, and high speed bearings 30 support pinion 18, keeping disks 24 and 26 in close coaxial alignment. A seal 32 is provided in housing 22 to seal against shaft 23, thereby containing an oil bath (not shown) in chamber 33 that surrounds mechanical diode 20. Mechanical diode 20 runs in this oil bath, which lubricates coupling plates 28 and provides a hydrodynamic film to be discussed below.

As best seen in FIGS. 5 and 6, a plurality of recesses 34 are provided in disk 24 to house coupling plates 28 when plates 28 are disengaged. A spring 36 is disposed in each recess such that it applies an outward force against its corresponding plate 28 tending to cause plate 28 to pivot from a disengaged position (FIG. 6) to an engaged position (FIG. 5). Disk 26 has a plurality of slots 38 that are configured to receive one end of plates 28 when plates 28 are in an engaged position.

When disk 24 and disk 26 are at rest—the typical relationship when starter assembly 10 is engaged—coupling plates 28 are impelled to pivot outwardly from disk 24 toward disk 26 by the action of their respective springs 36.

When the starter motor begins to rotate, disk 24 moves with respect to disk 26 in the direction indicated by the arrow at the base of disk 24 in FIG. 5. At least one coupling plate 28, forced outwardly toward disk 26 will enter a slot 38 (FIG. 5) and will apply a force against disk 26. This force, since it is applied away from the center of rotation of disk 26, applies a torque to disk 26 and causes it to rotate in the same direction and at the same speed as disk 24.

Once engine 14 starts, disk 26, driven by flywheel 12, speeds up rapidly to a velocity greater than that of disk 24. Disk 26 overtakes disk 24 and coupling member 28 is pushed back into its recess 34. As engine 14 gains more speed and the operator deenergizes the starter motor, the relative velocity of disk 26 with respect to disk 24 increases dramatically. This difference in velocity causes a hydrodynamic film to build up between disk 24 and disk 26 that lifts coupling plates 28 away from the surface of disk 26, thus substantially reducing friction between coupling plates 28 and the facing surface of disk 26. The springs 36, which act to pivot plates 28 toward contact with disk 26, are selected such that they will not force plates 28 through this hydrodynamically created film. In effect, coupling plates 28 float on an oil film generated by the rotation of disk 26 and do not wear substantially against disk 26 when the engine is running.

Figures 7, 8:
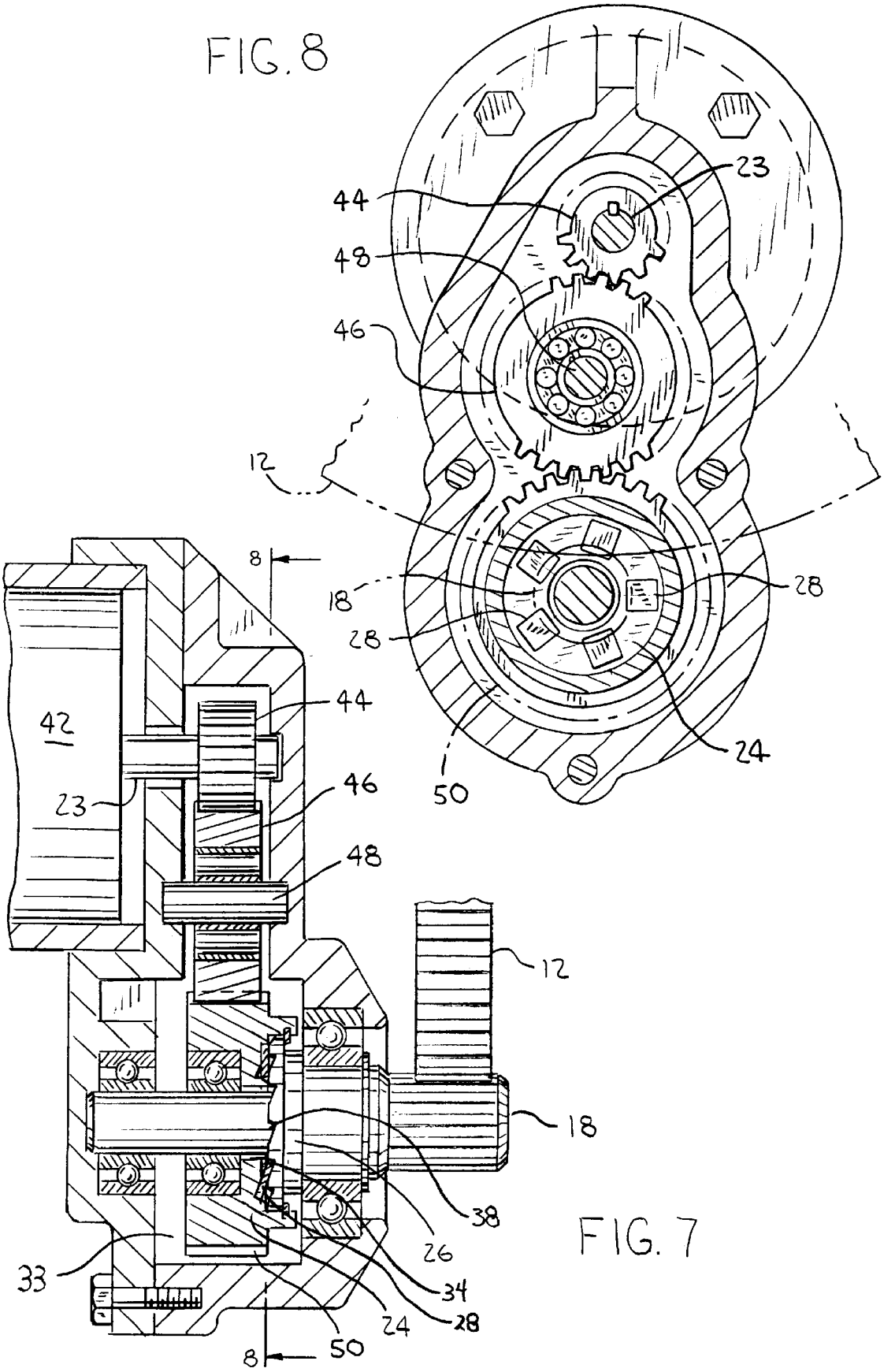
FIG. 7 shows an alternative arrangement of the starter assembly and flywheel of FIG. 1, wherein the starter assembly includes an additional gear train between the starter motor and the mechanical diode.
FIG. 8 is a sectional view of the starter assembly of FIG. 7 taken at Section 8—8 of FIG. 7.

FIGS. 7 and 8 illustrate another arrangement of the starter assembly that incorporates a different drive train between starter motor 42 and flywheel 12. In this arrangement, as well as the arrangement of FIGS. 1–5 a starter motor is coupled to a flywheel using a mechanical diode. In the arrangement of FIGS. 7 and 8, however, an additional gear train is disposed between mechanical diode 20 and starter motor 42 to allow the starter to be offset from pinion 18 and, if desirable, to change the relative rotational velocities of starter motor 42 with respect to pinion 18. In this arrangement, the shaft 23 extending from starter motor 42 is not fixed directly to disk 24, but is coupled to a spur gear 44. Gear 44, in turn, is rotationally coupled to spur gear 46 which is supported by and rotates about intermediate shaft 48. Gear 46, is rotationally coupled to gear 50 which is coupled to disk 24. Disk 24, in turn, engages and cooperates with coupling plates 28 and disk 26 in the manner described above with regard to FIGS. 1–5. Disk 26 in turn is rotationally coupled to flywheel 12 to start the engine as described above with regard to FIGS. 1–5. Engine 14 is coupled to flywheel 12, but is not shown in this figure for convenience.

Figure 9:
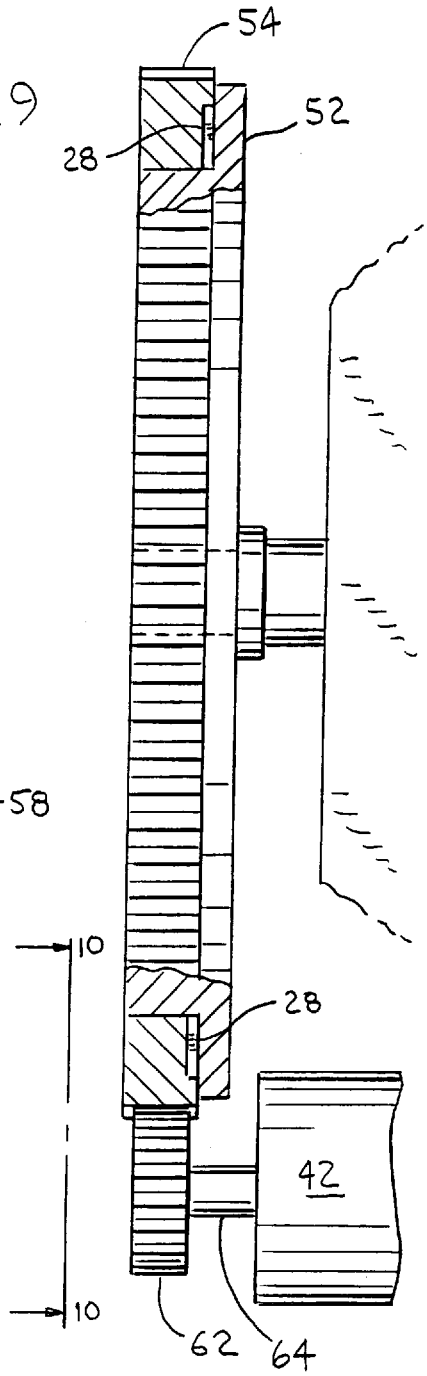
FIG. 9 illustrates a partial cross-sectional view of an alternative starter assembly and flywheel in which the starter assembly engages a spur gear coupled to the flywheel by a mechanical diode.
Figure 11:
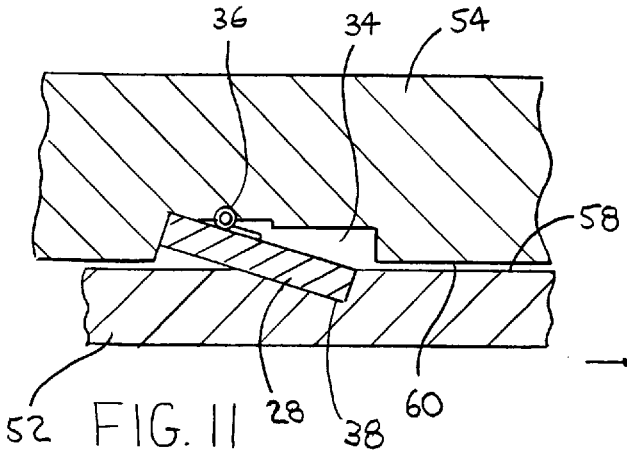
FIG. 11 is a sectional view of the arrangement of FIGS. 9 and 10 showing a typical coupling plate in an engaged position.
Figure 10:
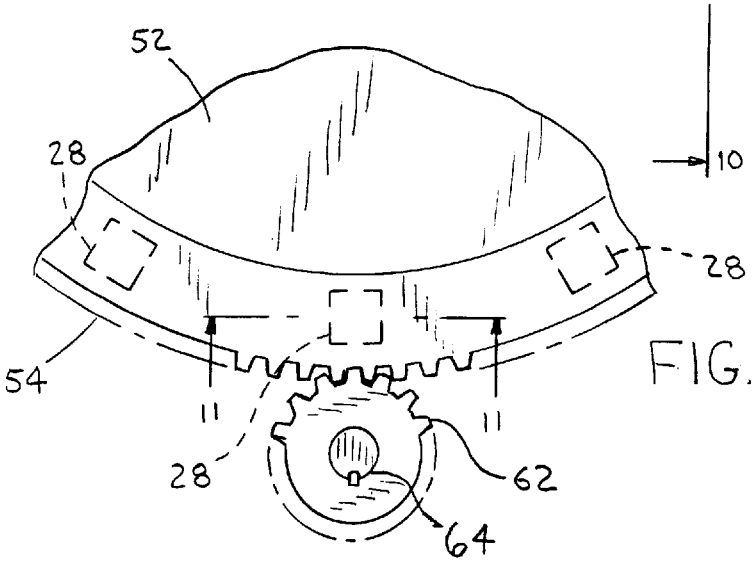
FIG. 10 is an end view of the arrangement of FIG. 9.

FIGS. 9–11 illustrate another arrangement of the present invention in which starter motor 42 is coupled to a flywheel 52 through a spur gear 54 and coupling plates 28 disposed between spur gear 54 and flywheel 52. As in the previous examples of mechanical diodes, the coupling plates are disposed in recesses in gear 54 and have outwardly extending ends that engage corresponding grooves in flywheel 52. Also similar to the previous examples, gear 54 and flywheel 52 are coaxial. Unlike the two previous arrangements, however, the mechanical diode in FIGS. 9–11, rather than being disposed adjacent to the flywheel, is disposed coaxially with the flywheel. Flywheel 52 and gear 54 have respective facing surfaces 58 and 60 that, together with coupling plates 26 disposed between surfaces 56 and 60, form a mechanical diode. As in the previous example, and for the same purposes, recesses 34 and slots 38 are provided in surfaces 60 and 58, respectively, to receive coupling plates 28 and to allow coupling plates 28 to transmit torque from gear 54 to flywheel 52. In this arrangement, starter motor 42 drives motor shaft 64 which is coupled to pinion gear 62. Pinion gear 62, in turn is rotationally engaged to gear 54 and drives it. Surface 60, coupling members 28 and surface 58 cooperate in the same manner as the mechanical diodes of the preceding figures to transmit torque to flywheel 52.

Figure 12:
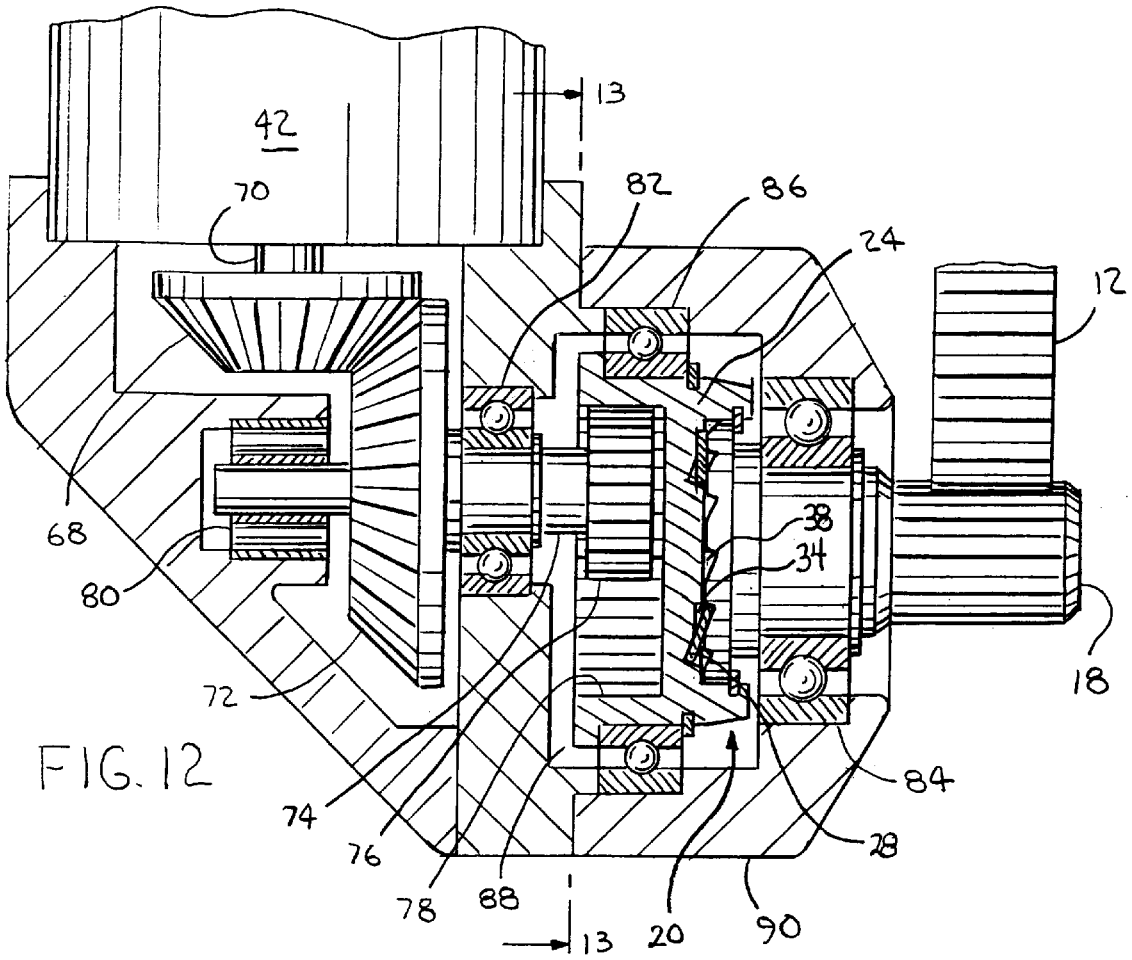
FIG. 12 illustrates a further variation of the starter assembly of FIG. 1 wherein the starter motor is coupled to the first disk of the mechanical diode through a right angle gear train, and an additional gear reduction is provided by a spur gear engaged to an internal spur gear.
Figure 13:
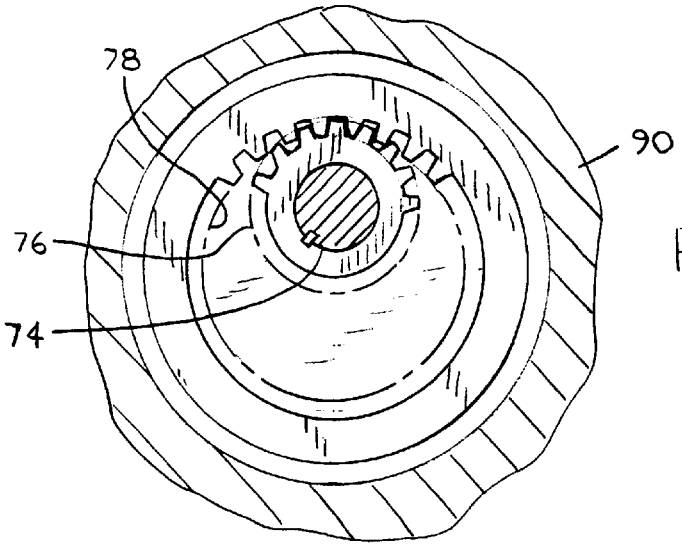
FIG. 13 is a sectional view of the arrangement of FIG. 12 taken at Section 13—13 in FIG. 12.

FIGS. 12–13 illustrate another arrangement of a starter assembly 66 in which the starter motor 42 is disposed at substantially a right angle from pinion 18. As in the previous examples, the starter motor is coupled to the flywheel through the mechanical diode 20, discussed in detail above. Bevel gear 68 is coupled to shaft 70 of starter motor 42. Bevel gear 68 is rotationally coupled to bevel gear 72 which is fixed to a first end of shaft 74 such that a substantially right angle is formed between the axes of rotation of bevel gears 68 and 72. The other end of shaft 74 is fixed to spur gear 76 which is rotationally engaged to internal spur gear 78. Shaft 74 is rotationally supported at one end by bearing 80 and by bearing 82. Pinion 18 is rotationally supported by bearing 84 and internal spur gear 78 is rotationally supported by bearing 86. As in the example of FIG. 2, a cavity 88 is formed by starter housing 90 surrounding disks 22 and 24 and coupling plates 28 that contains a lubricant for the creation of a hydrodynamic film as discussed above. The starter assembly of FIGS. 12–13 can be used in place of the starter assembly illustrated in FIG. 1 to start engine 14.

Thus, it should be apparent that there has been provided in accordance with the present invention a method and apparatus for starting an engine that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A starter assembly for an internal combustion engine comprising:

a starter motor;

a first disk rotationally coupled to the motor and having a first surface substantially perpendicular to an axis of rotation of the first disk, the first surface having a plurality of recesses;

a plurality of coupling plates disposed in the plurality of recesses;

a plurality of springs coupled to the plurality of coupling plates and the first disk to pivot a first end of the plate outwardly from the first disk about a plurality of pivotal axes substantially perpendicular to the rotational axis;

a second disk having the same rotational axis as the first disk and having a second surface substantially perpendicular to the axis and facing the first disk, the surface having a plurality of grooves adapted to receive the first end of the plurality of coupling plates to transmit torque from the first disk to the second disk; and a first gear rotationally coupled to the second disk and having teeth configured to engage a flywheel of the engine both when the engine is running and when the engine is not running;

wherein the first disk, the second disk and the coupling plates are disposed between the motor and the first gear.

2. The starter assembly of claim 1, wherein the second disk is coaxial with the first gear.

3. The starter assembly of claim 2, wherein the starter motor is coaxial with the first disk.

4. The starter assembly of claim 1, further comprising a spur gear train disposed between, and rotationally coupling, the starter motor and the first disk.

5. The starter assembly of claim 4, wherein the gear train includes a second gear coupled to a shaft of the starter motor, and a third gear coupled to the first disk.

6. The starter assembly of claim 5, further comprising a fourth gear rotationally coupled to and disposed between the second and third gears.

7. The starter assembly of claim 1, further comprising:

a right angle gear train is disposed between, and rotationally coupling, the starter motor and the first disk.

8. The starter assembly of claim 7, wherein the right angle gear train includes a first bevel gear fixed to a shaft of the starter motor and a second bevel gear rotationally coupled to the first bevel gear and rotationally coupled to the first disk.

9. The starter assembly of claim 8, further comprising:

a first spur gear coupled to the second bevel gear; and an internal spur gear fixed to the first disk and rotationally coupled to the first spur gear, whereby the second bevel gear is rotationally coupled to the first disk.

10. The starter assembly of claim 1, further comprising:

a housing at least partially encompassing the first disk, the second disk and the coupling plates and configured to contain a lubricant.

11. The starter assembly of claim 10, wherein the lubricant is an oil bath at least partially filling the housing.

* * * * *